US006863191B2

(12) United States Patent
Kesling

(10) Patent No.: US 6,863,191 B2
(45) Date of Patent: Mar. 8, 2005

(54) PAINT CAN BAIL AND BRUSH HOLDER

(76) Inventor: David L. Kesling, 2711 W. 200 South, LaPorte, IN (US) 46350

( * ) Notice: Subject to any disclaimer, the term of this patent is extended or adjusted under 35 U.S.C. 154(b) by 0 days.

(21) Appl. No.: 10/379,253

(22) Filed: Mar. 4, 2003

(65) Prior Publication Data

US 2004/0173627 A1 Sep. 9, 2004

(51) Int. Cl.[7] ..... B65D 6/08
(52) U.S. Cl. ..... 220/697; 220/736; 220/735
(58) Field of Search ..... 220/697, 736, 220/735

(56) References Cited

U.S. PATENT DOCUMENTS

| | | | | |
|---|---|---|---|---|
| 98,291 | A | * | 12/1869 | Nashold |
| 1,193,585 | A | * | 8/1916 | Martindale |
| 2,564,043 | A | * | 8/1951 | Ward |
| 2,634,937 | A | | 4/1953 | Welsh |
| 2,896,894 | A | | 7/1959 | Welsh |
| 3,029,054 | A | | 4/1962 | Mott |
| 3,207,463 | A | | 9/1965 | Downey |
| 3,223,373 | A | | 12/1965 | Molinaro |
| 3,357,668 | A | | 12/1967 | Carrel |
| 3,627,245 | A | | 12/1971 | Lewis |
| 4,823,433 | A | | 4/1989 | Curtis |
| 4,832,293 | A | | 5/1989 | Gizzi |
| 4,993,767 | A | * | 2/1991 | Song |
| 5,377,863 | A | * | 1/1995 | Widman |
| 5,626,319 | A | | 5/1997 | Fusillo |
| 5,806,818 | A | | 9/1998 | Heywood |
| 5,853,157 | A | | 12/1998 | O'Donnell |
| 5,996,952 | A | | 12/1999 | Heywood |
| 6,135,310 | A | | 10/2000 | Svehaug |
| 6,494,417 | B1 | * | 12/2002 | Gizzi |

* cited by examiner

*Primary Examiner*—Joseph Man-Fu Moy
(74) *Attorney, Agent, or Firm*—Baker & Daniels

(57) ABSTRACT

A bail holder for a container, such as a paint can, includes a planar body having an upper portion engaging the bail and a lower portion engaging the upper rim of the can. The upper portion includes a hole and a slot connecting the hole to an edge of the body, thus allowing the bail to be placed in the hole for retention therein. The lower portion of the body includes a notch for engagement with the inner lip of the can, a tab on one side of the notch that engages a channel on the upper side of the rim, and a leg on the other side of the notch extending to the underside of the rim to engage the ridge formed by the bottom of the channel. A hook extending from edge of the body is provided for hanging a paint brush over the can interior.

15 Claims, 5 Drawing Sheets

PAINT CAN BAIL AND BRUSH HOLDER

FIELD OF THE INVENTION

This invention relates generally to painting accessories, and particularly to a paint can bail holder that keeps the bail in a semi-upright position for easy access by the painter and combined with a holder for a paint brush.

BACKGROUND OF THE INVENTION

House paint is sometimes sold in one-gallon containers. The containers, or cans, as they are commonly referred to, have wire loop handles (bails) attached near the top of the can. These handles or bails can pivot over the top of the can from one side to the other and are typically pivoted down against the side of the can when the can is not being carried. The upper rim of the paint can typically include an inwardly projecting lip, with the lip defining a channel for receiving and holding a corresponding downwardly projecting ring on the can lid. The interference fit of the ring on the can lid with the channel at the can's upper rim facilitates sealing of the lid to the can. The channel formed in the rim of the can also define a groove on the underside of the lip between the can side wall and the channel.

When painting with a brush, painters dip their paint brush into the can to load the brush with paint. This is an easy task when the paint can is full, as the painter simply dips the brush straight into the can to load the paint onto the brush. However, as the paint level in the can becomes lower, this task becomes more difficult. As the paint level lowers, the painter must insert the brush and their hand down into the can to retrieve paint. This usually either does not fully coat the brush, or otherwise causes the painter's hand and/or brush handle to come into contact with the paint rim or can, creating a messy situation. If the painter should be holding the paint can by the bail, the area for insertion of the brush is minimized, as the painter must insert the brush into the area between the bail and the can rim.

A second problem when painting from a can involves temporarily securing the paint brush during interruptions. In most manual painting jobs, there are many instances where the brush is laid down during the painting process, either allowing the painter to rest, do preparation work, or changing location that interrupt the painting activity. At these times, the painter is concerned with how to avoid dripping or losing paint from the brush. Traditionally, the painter lays the brush on or across the top edge of the paint can hoping to minimize the dripping of paint outside the can. However, balancing a brush on a can is less than secure as the brush can easily be knocked off. Also when the brush is positioned across the can, the brush handle normally picks up paint on the handle as the rim of the can normally has wet paint therearound.

Various attempts have been undertaken in the prior art to address these or similar problems. One example is shown in U.S. Pat. No. 4,832,293 to Gizzi, which discloses an accessory that attaches to the bail of a paint can and provides a carry handle and a hook for holding the paint brush.

Another example is shown in U.S. Pat. No. 6,135,310, which discloses a combination paint brush holder and paint pourer that also includes an auxiliary handle.

Accordingly, there is a need for a painting accessory that easily and readily attaches to an opened paint can, that holds the bail in a position that is conveniently accessible to the painter and keeps the bail free of paint, and provides a means for holding the paint brush so that any drippage from the brush goes back into the can.

SUMMARY OF THE INVENTION

The present invention provides a handle or bail holder for a container that includes a rigid planar body having an upper portion that engages the bail and a lower portion that engages the lip of the container. In one embodiment, the bail engagement portion includes a hole through the planar body and a slot connecting the hole to an outward rearward facing edge of the planar body that allows passage of the bail to the hole where it is retained against the upper portion of the hole. The lip-engaging portion includes a projection that engages a channel on the upper side of the lip and a leg that engages a ridge on the underside of the lip. The bail holder, when attached to the container, holds the bail in a semi-upright position conveniently accessible to the user.

Thus when the raised bail is lifted, the can is tipped, which causes the paint to flow into the area towards the can rim which is opposite the bail clip. This simplifies the task of dipping the brush into the paint, as the painter may now simply dip the brush into the paint adjacent to the rim. As the painter is holding the can by the bail clip, the area for insertion of the brush is increased.

The invention further provides a brush holder in the form of a hook extending from the inward facing edge of the upper portion of the planar body. The hook is sized for insertion into a hole in the handle of the paint brush to hold the brush.

In a further aspect of the invention, the planar body is sufficiently thin to be held between adjacent fingers of the hand of a user when gripping the bail.

Accordingly, the invention provides a bail holder that easily attaches to a paint can and holds the bail in a position that is conveniently accessible to the painter and keeps the bail free upright of the paint can, such that when the bail is grasped and lifted, the paint can is tilted and the paint level is moved towards the can rim. The invention accomplishes a further objective of providing a paint brush holder that holds the brush over the can so that excess paint dripping from the brush goes back into the can. The invention accomplishes a still further objective of providing a bail and brush holder that is simple in design and easy to construct.

DESCRIPTION OF THE PREFERRED EMBODIMENTS

Figure 1:
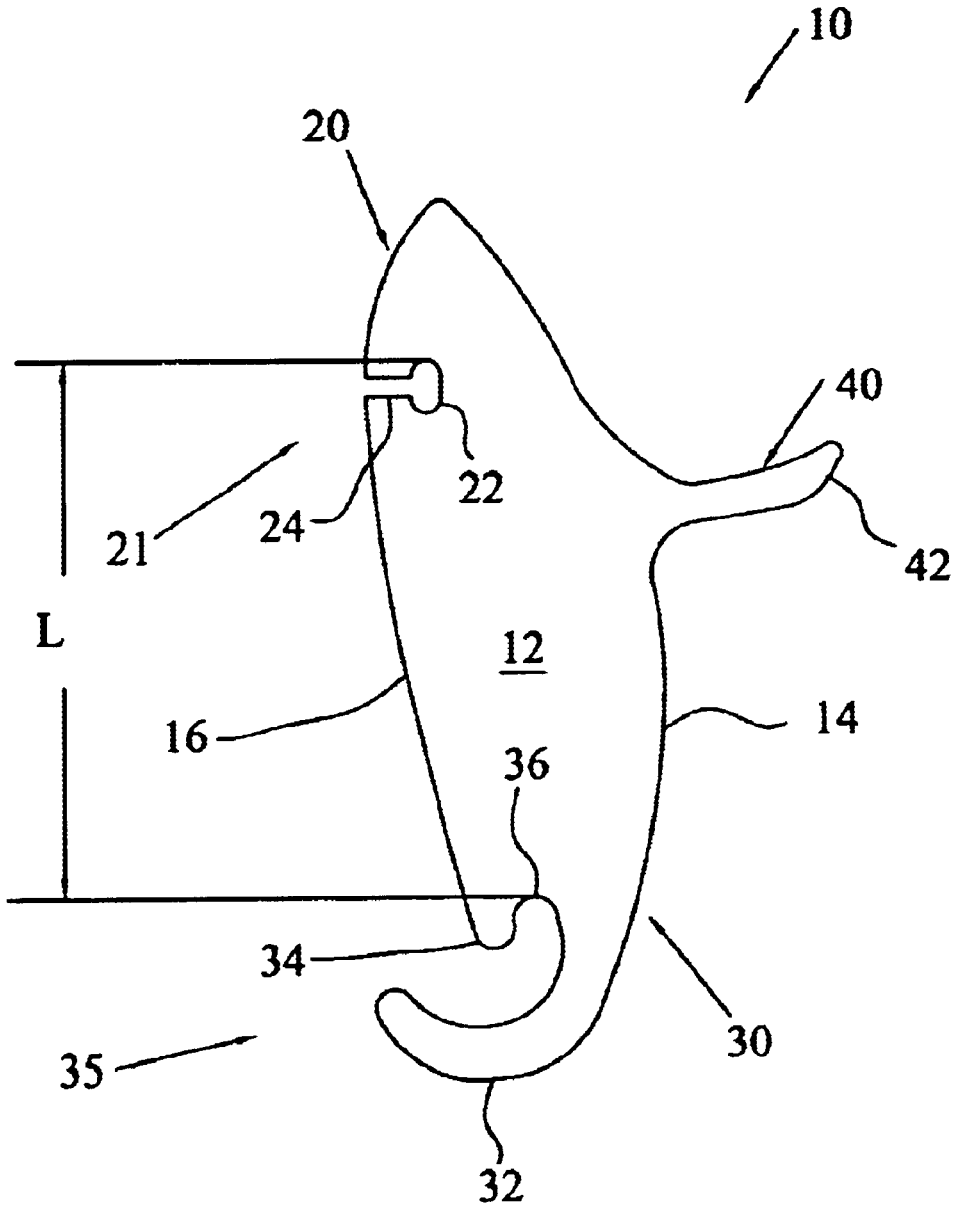
FIG. 1 is a side elevational view of the preferred embodiment of a bail holder according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, one embodiment of a bail holder according to the present invention is shown generally indicated by the numeral 10. The bail holder has a planar body 12 having an upper portion generally represented at 20 and a lower portion generally represented at 30. The planar body 12 has an inward facing edge 14 and an outward facing edge 16. In this discussion, inward and outward are defined relative to the container opening with inward being toward the center of the container opening and outward being away from the center of the container opening. Hook 40 extends from the inner edge 14 at the upper portion 20 of body 12. The end 42 of hook 40 is sized to be received in a hole at the end of a paint brush handle.

Upper portion 20 defines a bail holder 21, comprised of a hole 22 within the body portion and a slot 24 connecting the hole 22 to the outward facing edge 16 of the body 12. Slot 24 provides a passageway for placing the container bail in the hole 22. Preferably slot 24 joins hole 22 at a point that is not in an uppermost portion of the hole to facilitate the secure retention of the bail therein, as well as the easy removal thereof. It is also preferred to have the hole 22 slightly smaller than the diameter of the bail wire, to create a slight interference fit therebetween. The shape of the hole is not critical to the invention; however, a circular or elliptical geometry would be preferred. While the hole 22 and slot 24 is the preferred embodiment, it is anticipated that many geometries could also be used. For example, an upwardly curving slot would also be possible, where the slot is substantially the same dimension throughout its length. The dimension in this case would be slightly smaller than the diameter of the bail wire.

The lower portion 30 of the planar body 12 includes a support aperture 35 defined by a first leg 32, a second leg 34, and a notch 36. Preferably, the second leg 34 is less prominent than the first leg 32. The lower portion 30 engages the rim of the container as will next be described.

Figure 2:
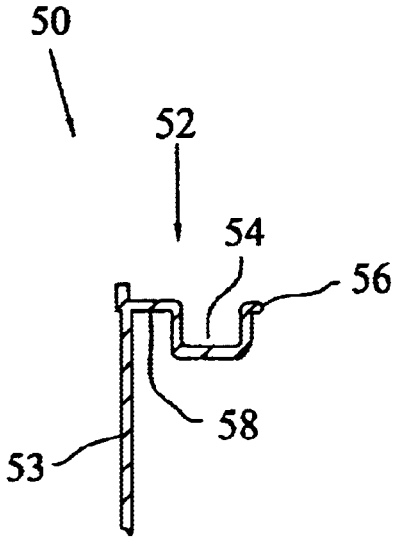
FIG. 2 is a cross-sectional view of a rim of a container typical of a paint can.

With reference now to FIG. 2, there is shown a representative cross-section of the rim 50 of a container of the type commonly used for paint cans. The rim 50 includes an inwardly projecting lip 52 having a circumferential channel 54 that receives a corresponding ring on the lid (not shown) of the can for sealing the lid to the can. As shown in FIG. 2, lip 52 extends inwardly from the outer circumferential wall 53 by way of horizontal wall portion 58. Finally, the outer extremity of channel 54 defines upstanding lip 56.

Figure 3:
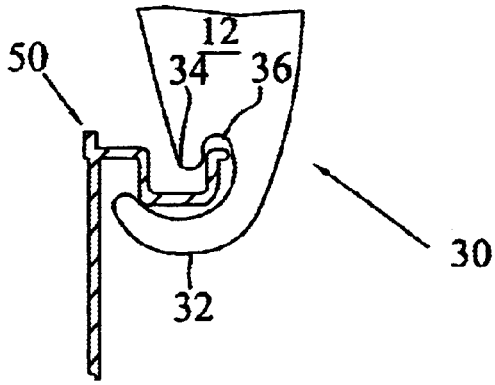
FIG. 3 is a side view showing the engagement of the lower portion of the bail holder of FIG. 1 with the container of FIG. 2.

Turning now to FIG. 3, the lower portion 30 of the bail holder body 12 is shown attached to the rim 50 of a can. Here, notch 36 is shown resting on the inner edge 56 of the lip 52. Leg 34 extends into the channel 54 and leg 32 engages the interior ridge 55 formed by channel 54, with the free end of leg 32 residing adjacent to inner ridge 55.

Figure 4:
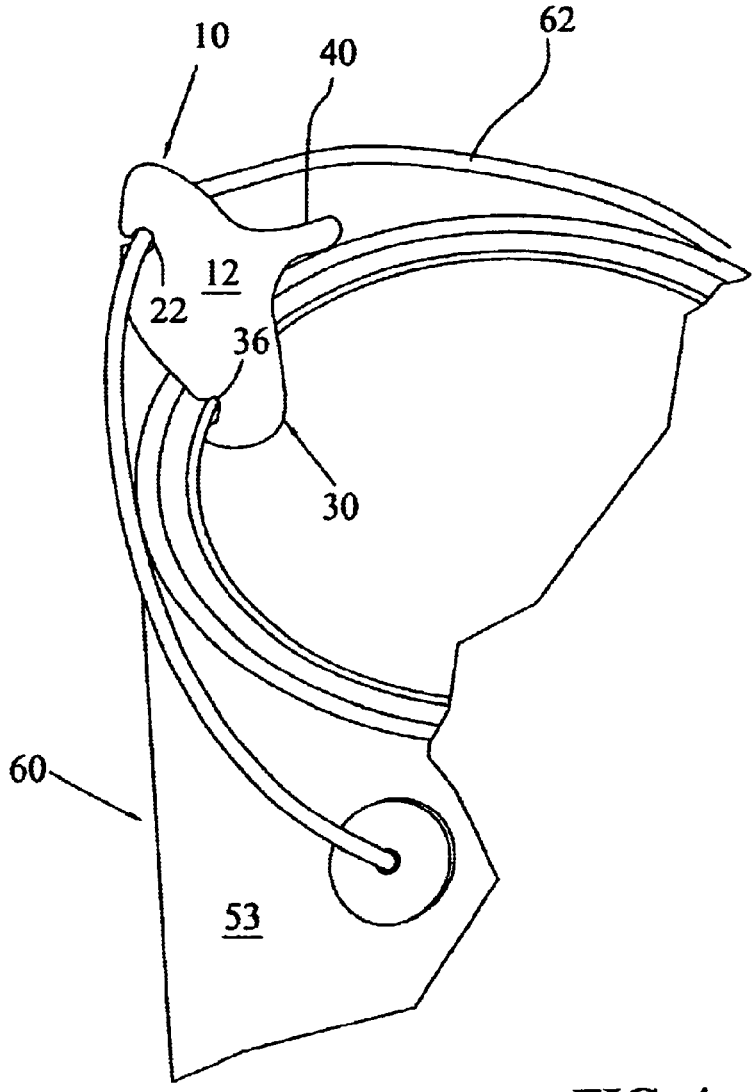
FIG. 4 is a partial perspective view of a paint can with the bail holder of FIG. 1 attached.
Figure 5:
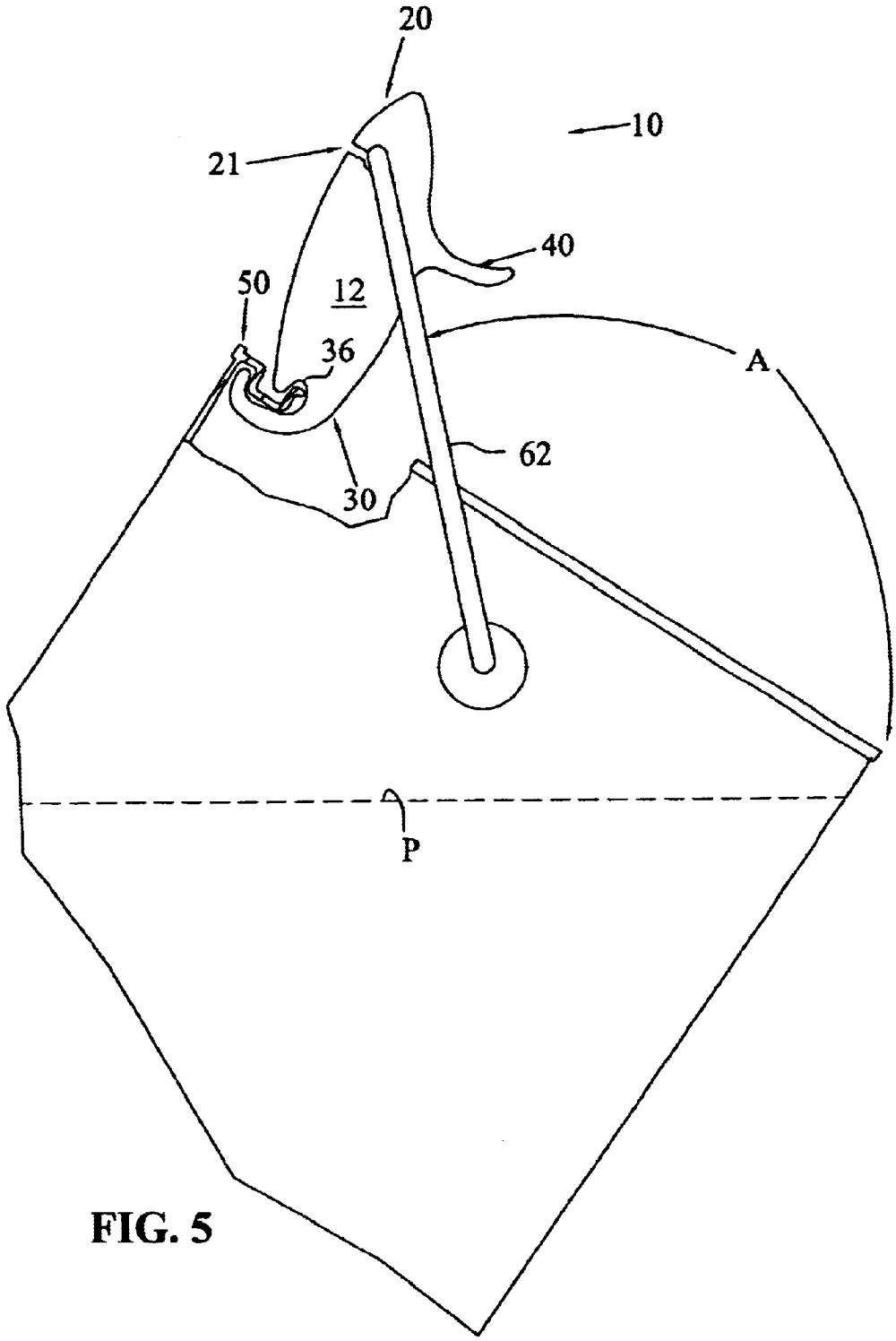
FIG. 5 is a partially fragmented side view of the bail clip of the present invention attached to the lip of the can, and to the bail of the can, with the can tipped.

With reference now to FIG. 4, bail holder 10 is shown attached to a can 60 with bail 62 engaged in the hole 22. When bail holder 10 is attached to the bail 62, the bail holder 10 is interferingly held to the bail. The bail holder 10 of the present invention holds the bail above the top rim of the can at a readily accessible position for the painter. This also positions the bail at a position away from the periphery of the can, so that it remains free from paint that might drip or run down the outside of the can.

When the paint level becomes low, the user simply grasps the bail 62, with the bail holder 10 between two adjacent fingers of the hand, and lifts the can upwardly. As shown, this provides an enlarged area A through which the brush can be inserted for dipping into the paint.

Figure 6:
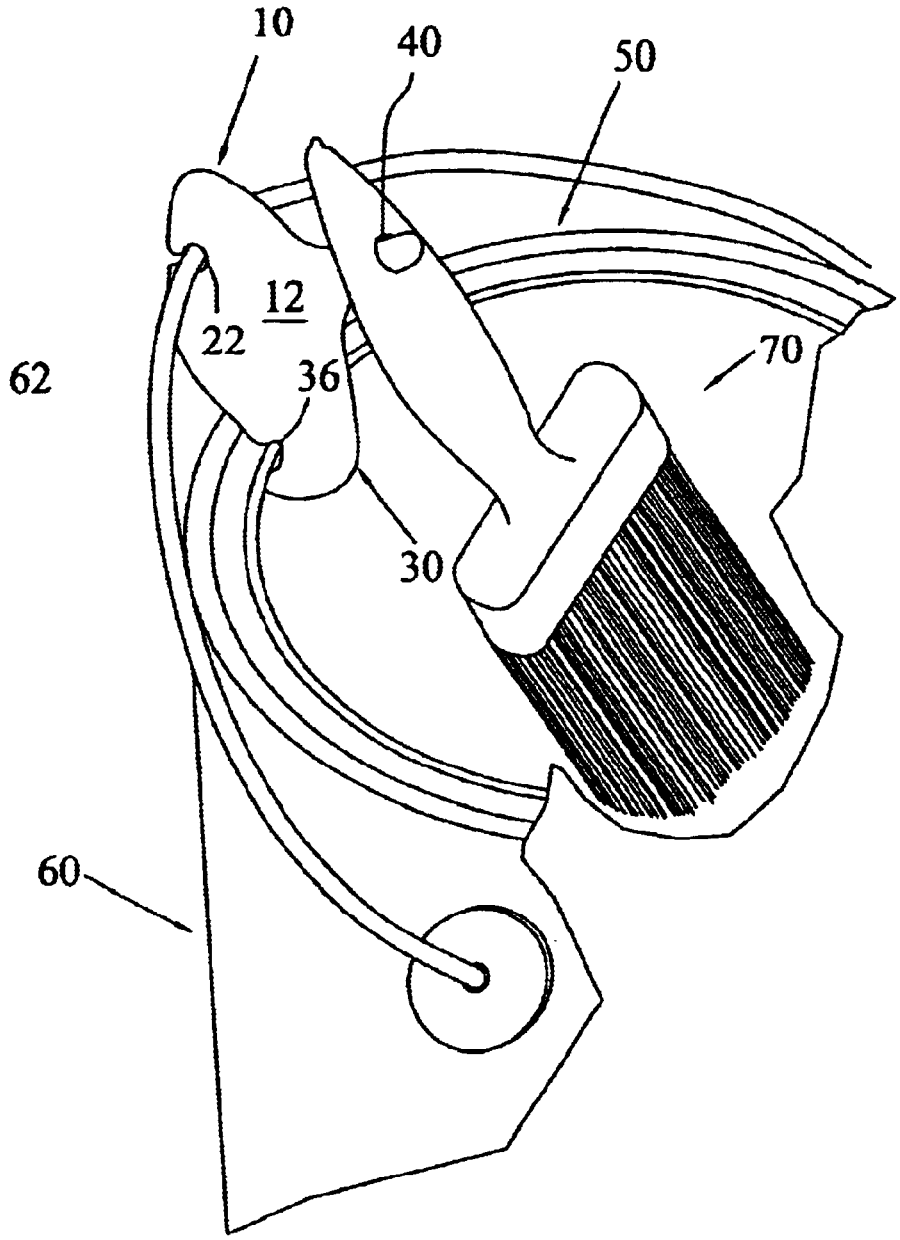
FIG. 6 is a partial perspective view of a paint and bail holder as in FIG. 4, with a paint brush suspended from the bail holder.

As shown in FIG. 6, hook 40 also provides a temporary resting place for a paint brush 70. This is accomplished by placing the aperture through the end of brush 70 onto hook 40. This assures that any paint drippage goes back into the can, not onto the floor or down the outside periphery of the can. Thus the objectives of the invention are advantageously accomplished.

In the preferred embodiment of the invention, the bail holder 10 is molded from an inexpensive material such as plastic. However, the composition of the holder 10 is not material to the invention. It is also possible to have a plurality of apertures such as 21 at various positions along the edge 16, varying the distance between the bail and the lip of the can. This allows the bail to be applied to various apertures, to vary the tipping angle of the can to accommodate the changing paint level in the can.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A bail holding attachment for a container having a pivotally mounted bail handle and an inwardly projecting lip at an upper rim thereof, said bail holding attachment comprising a body member having an upper portion configured with a bail holder for attachment to the bail handle of the container and a lower portion configured with a support member profiled for attachment with both the upper and lower portion of the rim of the container, said body member extending at least between the bail handle and lip, yet profiled to allow access to the bail handle to lift the container by the bail handle, whereby the bail handle is held in a semi-upright position, such that lifting the bail handle lifts said container at an angle relative to the bail handle.

2. The bail holding attachment of claim 1, wherein said upper portion of said body member is sized to fit between adjacent fingers of a hand of a user grasping the bail handle.

3. The bail holding attachment of claim 2, wherein said body member is planar.

4. The bail holding attachment of claim 1, wherein the body member defines an inward facing edge facing toward an opening of the container and an outward facing edge facing away from said container opening, and said bail holder is defined by an aperture adjacent to said outward facing edge.

5. The bail holding attachment of claim 4, wherein said aperture is profiled for being interferingly held to said bail.

6. The bail holding attachment of claim 4, wherein said aperture is spaced inwardly of said outward facing edge, and a slot interconnects said aperture to said outward facing edge.

7. The bail holding attachment of claim 1, wherein said body defines an inward facing edge facing toward an opening of the container and an outward facing edge facing away from said container opening, and said body further defining a hook portion projecting from said inward facing edge, whereby said hook portion has an end sized to be received in a hole in a handle of a paint brush for holding said paint brush.

8. A handle holding attachment for a container having a pivotally mounted handle and an inwardly projecting lip at an upper rim thereof, said handle holding attachment comprising:

a planar body having an upper portion configured for engagement with the handle of the container and a lower portion configured for engagement with the rim of the container, said body defining an inward facing edge facing toward an opening of the container and an outward facing edge facing away from said container opening, said upper portion of said body further defining a hole therethrough and a slot extending from said hole to said outward facing edge of said body, the handle receivable in said slot for passage to said hole for retention therein, and said lower portion including a first projection engaging an inner portion of the rim of the container and a second projection engaging an outer portion of the rim of the container, and a notch disposed between said first projection and said second projection, said notch engaging an inward edge of said lip, whereby the handle is held in a semi-upright position.

9. The handle holding attachment of claim 8, wherein said body further includes a hook portion projecting from said inward facing edge, said hook portion having an end sized to be received in a hole in a handle of a paint brush for holding said paint brush.

10. The handle holding attachment of claim 8, wherein said upper portion of said body is sized to fit between adjacent fingers of a hand of a user grasping the handle.

11. A bail holding attachment for a container having a pivotally mounted bail handle and an inwardly projecting lip at an upper rim thereof, said bail holding attachment comprising a planar body member having an upper portion configured with a bail holder for attachment to the bail handle of the container and a lower portion configured with a support member profiled for attachment with the rim of the container, the body portion extending at least between the bail and lip and is sized to fit between adjacent fingers of a hand of a user grasping the handle, yet profiled to allow access to the bail to lift the container by the bail, whereby the handle is held in a semi-upright position, such that lifting said bail lifts said container at an angle relative to the bail.

12. The bail holding attachment of claim 11, wherein the body member defines an inward facing edge facing toward an opening of the container and an outward facing edge facing away from said container opening, and said bail holder is defined by an aperture adjacent to said outward facing edge.

13. The bail holding attachment of claim 12, wherein said aperture is profiled for being interferingly held to said bail.

14. The bail holding attachment of claim 12, wherein said aperture is spaced inwardly of said outward facing edge, and a slot interconnects said aperture to said outward facing edge.

15. The bail holding attachment of claim 11, wherein said body defines an inward facing edge facing toward an opening of the container and an outward facing edge facing away from said container opening, and said body further defining a hook portion projecting from said inward facing edge, whereby said hook portion has an end sized to be received in a hole in a handle of a paint brush for holding said paint brush.

* * * * *